United States Patent [19]

Nagel

[11] Patent Number: 4,583,151

[45] Date of Patent: Apr. 15, 1986

[54] ILLUMINATED DISPLAY

[75] Inventor: Robert I. Nagel, Mesa, Ariz.

[73] Assignee: Allen-Bradley Company, Milwaukee, Wis.

[21] Appl. No.: 663,670

[22] Filed: Oct. 22, 1984

[51] Int. Cl.[4] ..... F21V 33/00; H01H 9/16

[52] U.S. Cl. ..... 362/29; 362/331; 362/333; 362/340; 362/812; 200/316

[58] Field of Search ..... 362/29, 330, 331, 332, 362/333, 334, 339, 340, 812; 200/311, 313, 314, 316

[56] References Cited

U.S. PATENT DOCUMENTS

| | | | |
|---|---|---|---|
| Re. 18,187 | 9/1931 | Rolph | 362/331 |
| 1,139,395 | 5/1915 | Armantage et al. | 362/333 |
| 1,151,343 | 8/1915 | Conner et al. | 362/333 |
| 1,523,384 | 1/1925 | Anbuckle | 362/812 |
| 1,524,446 | 1/1925 | Meacher | 362/812 |
| 1,764,485 | 6/1930 | Wiley | 362/812 |
| 1,955,599 | 4/1934 | Lamblin-Parent . | |
| 2,220,639 | 11/1940 | Borsarelli | 362/333 |
| 2,334,479 | 11/1943 | Creager | 116/124.4 |
| 3,238,654 | 3/1966 | Rosewak et al. | 362/812 |
| 3,334,958 | 8/1967 | Appeldorn | 350/211 |
| 3,740,501 | 6/1973 | Kiessling et al. | 200/16 R |
| 3,770,925 | 11/1973 | Nelson et al. | 200/168 C |
| 4,071,726 | 1/1978 | Werda | 200/311 |
| 4,141,058 | 2/1979 | Mizohata et al. | 362/812 |
| 4,146,306 | 3/1979 | Wallach | 350/211 |
| 4,177,505 | 12/1979 | Carel | 362/339 |
| 4,371,916 | 2/1983 | De Martino | 362/331 |
| 4,404,445 | 9/1983 | Baran et al. | 200/314 |

FOREIGN PATENT DOCUMENTS

| | | | |
|---|---|---|---|
| 2415335 | 9/1979 | France | 362/29 |
| 2007842 | 5/1979 | United Kingdom | 362/29 |

OTHER PUBLICATIONS

Dennis Vanderwerf, Approximating the Fresnel Lens, Electro-Optical Systems Design, Feb. 1982, pp. 47-51.

*Primary Examiner*—Ira S. Lazarus

*Attorney, Agent, or Firm*—Quarles & Brady

[57] ABSTRACT

An illuminated display forming part of a twist type switch is disclosed. An operator display is formed from a transparent material having a high index of refraction. A cylindrical portion is formed on the back of the operator display which is mounted on the switch and defines a space in which an indicator lamp is mounted. A peripheral flange portion is formed forward of and radially outward from the cylindrical portion. The rear surface of the flange portion is contoured with a plurality of prisms which are arranged in the shape of the information to be displayed. The prisms concentrate and collimate the light emitting from the indicator lamp and passing through the cylindrical portion and direct it out the front of the operator display. The transverse cross section of the resulting beam is in the general shape of the display and is readily visible to an observer in front of the display.

10 Claims, 5 Drawing Figures

ILLUMINATED DISPLAY

BACKGROUND OF THE INVENTION

The field of the invention is illuminated information displays, and more particularly, operator displays for electrical controls.

For certain applications and in certain countries, switches which are actuable or releasable by a twisting motion are preferred or required. Such switches can be incorporated into a control circuit to be either push-on and twist-off or push-off and twist-on. The pushbutton operators of these switches can be made of a transparent plastic material and a lamp can be provided behind the operator to illuminate the operator in either its extended or its retracted position, or in both positions. A switch of this type is fully described in Baran et al U.S. Pat. No. 4,404,445 issued Sept. 13, 1983.

One problem with such twist type switches is that the switch operating personnel must be informed of the direction of rotation of the switch operator in order to either actuate or to release the switch. This is especially important when the switch must be twisted to either energize or de-energize a circuit in an emergency situation. Some indicator must therefore be provided on the switch or on the control panel to inform the operating personnel which direction to turn the operator to manipulate the switch.

Such an indicator could be provided as a printed instruction or as a label on the control panel. One problem with providing the instruction on the control panel is that the switches may be sold separately and assembled to the control panel in the field. Field assembly personnel would therefore be required to affix the instruction to the control panel properly and in a location proximate to the switch so that it would be readily visible by the operating personnel. Of course, this introduces a chance for error into the installation of a twist type switch which should be avoided.

Another solution to providing instructions on how to operate a switch would be to apply a printed instruction or a label directly to the switch. A problem with this solution is that these switches can be subjected to harsh environments where solvents and hard use can eradicate printed matter or destroy a label. Also, this solution requires an extra operation in manufacturing to apply the instruction.

Yet another solution to providing instructions on how to operate a switch would be to mold or engrave the instructions into the operator portion of the switch. Engraved or molded instructions are more durable than printed instructions so that this would be one way to overcome the problem outlined in the previous paragraph. However, molded or engraved instructions would be the same color as the operator portion and would therefore not be highly visible as required of instructions for such control switches. Therefore, it can be appreciated that a need exists for an improved means for clearly and durably displaying instructions for electrical controls and particularly, for twist type electrical switches.

SUMMARY OF THE INVENTION

This invention provides an improved illuminated display for clearly and durably communicating information to an observer positioned forward of the display. A display of the invention is formed from a material having an index of refraction substantially greater than 1. A plurality of prisms are formed on the rear surface of the display and are arranged in a shape which is representative of the information to be communicated. The prisms redirect the light entering them into a collimated light beam having a transverse cross section which is in the general shape of the display. As the collimated beam passes through the forward surface of the display, it is directed to be readily visible by the observer.

In an especially useful embodiment of the invention, the display comprises an operator display having a generally circular cylindrical rearward portion which defines a circular cylindrical space and a peripheral flange portion which is disposed radially outward from and forward of the cylindrical portion. A support means mounts the cylindrical portion and holds the indicator lamp within the cylindrical space. The prisms are formed on the rearward surface of the flange portion. Light emitted from the filament passes through the cylindrical portion before being redirected by the prisms into generally parallel rays in the shape of the display which pass through the forward surface of the flange portion.

In another aspect of the invention, the prisms comprise a series of concentric ridges. Each ridge has an entrance surface and a reflecting surface. Light emitted from the filament enters the entrance surface and is refracted so that it is incident upon the reflecting surface at a relatively large angle. The ray is thereby reflected by total internal reflection at the reflecting surface so that the ridges act as catadioptric prisms.

In another aspect of the invention the forward surface of the flange portion is slanted rearwardly. Light from the reflecting surface of the ridges is refracted by the forward surface to be generally parallel to the horizontal axis of the cylindrical portion. This enables exposing a larger area of the entrace surfaces to the light emitted from the filament than if the forward surface were in a vertical plane.

Another aspect of the invention provides the area of the forward face of the flange portion which is aligned with the prisms along the light rays which pass between the rearward and the forward surfaces of the flange portion as a raised surface. The raised surface is in the shape of the display. This further defines the cross section of the collimated beam to make for a sharper and clearer image of the information to be displayed.

In another aspect of the invention, the support means comprises an electrical twist type switch. The operator display forms a portion of a movable actuator which is rotatable to operate the switch. The prisms are arranged in the shape of an arrow to indicate the direction of rotation of the operator display. The switch thus provided clearly and durably bears its own operating instructions without any additional parts or assembly steps and with no reliance upon field maintenance personnel.

In yet another aspect of the invention, the support means comprises a circular cylindrical sleeve which is made from a transparent material having an index of refraction substantialy greater than one. The cylindrical portion of the operator display is mounted to the sleeve of the support means in overlapping relationship. The light rays emitted from the filament pass through both the cylindrical portion and the sleeve. Thereby, a display of the invention can be adapted to many different applications.

A display of the invention provides an improved means for clearly and durably displaying instructions for electrical controls, and particularly, for twist type electrical switches. A display of the invention is highly visible and is not susceptible to being destroyed or eradicated. It is also easily provided as it can be molded into the operator portion of a switch or other electrical control.

The foregoing and other advantages of the invention will appear from the following description. In the description, reference is made to the accompanying drawings which form a part hereof, in which there is shown by way of illustration a preferred embodiment of the invention. Such embodiment does not necessarily represent the full scope of the invention, however, and reference should therefore be made to the claims for interpreting the scope of the invention.

DETAILED DESCRIPTION OF THE PREFERRED EMBODIMENT

Figure 1:
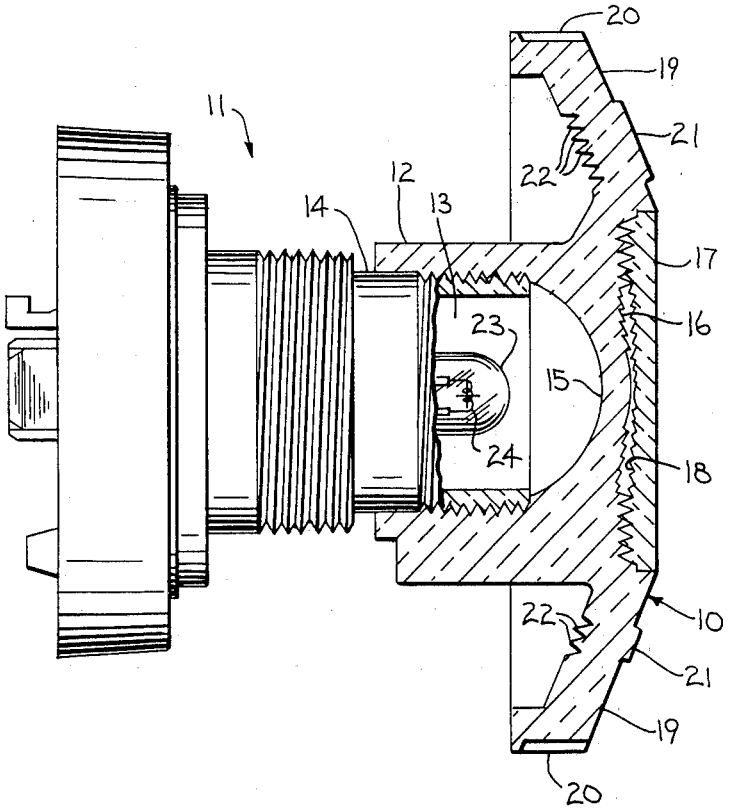
FIG. 1 is a view partially in section of an electrical twist type switch incorporating a display of the present invention.
Figure 2:
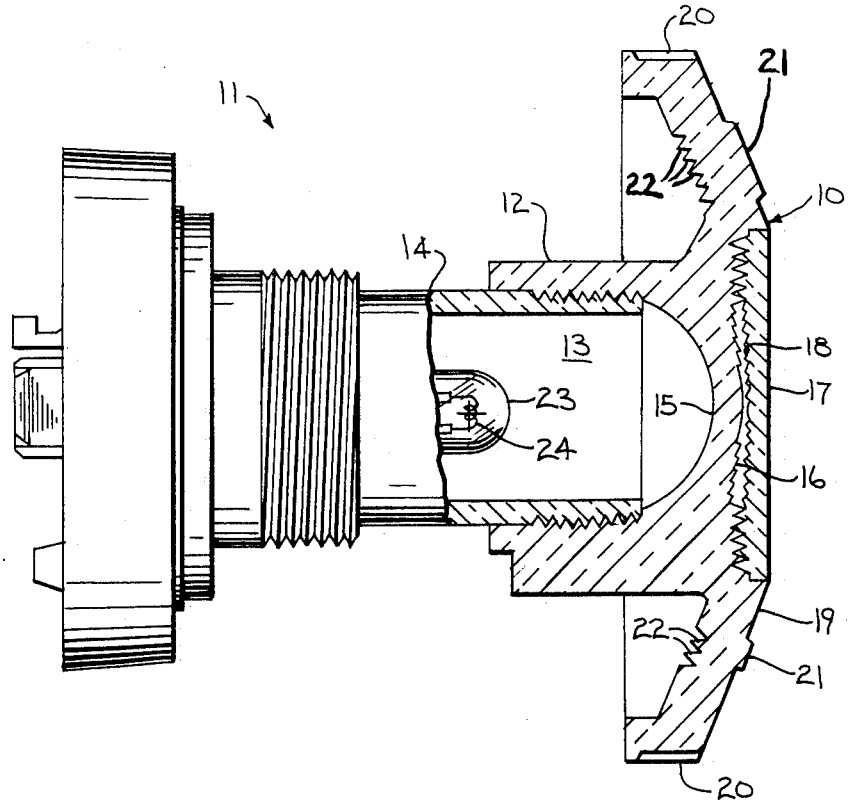
FIG. 2 is a view similar to FIG. 1 but with the display in a different position relative to the indicator lamp.

Referring to FIGS. 1 and 2, an illuminated display of the present invention is incorporated in an operator display 10 which forms part of a twist-to-release switch 11. The switch 11 is operable from a retracted position (FIG. 1) to an extended position (FIG. 2) by turning the operator display 10 in a given direction. Either the retracted position or the extended position can be "off" or "on", depending upon how the contacts of the switch 11 are arranged and how the switch is incorporated into a control circuit. Apart from the operator display 10, the switch 11 is fully disclosed in the Baran et al U.S. Pat. No. 4,404,445 referred to above, which is hereby incorporated by reference.

The operator display 10 is mounted to the switch 11 by generally circular cylindrical rearward portion 12 which defines a circular cylindrical cavity 13. The inside diameter of the cylindrical portion is threaded so that the operator display 10 can be securely fastened to a sleeve 14 of the switch 11 which has matching external threads. As thus mounted, the sleeve 14 turns with the operator display 10 when the operator display is twisted to actuate or deactuate the switch.

The cavity defined by the cylindrical portion 12 terminates at its forward end in a spherical radius 15. Forward of the radius 15 and extending a distance radially outward therefrom is an optical surface 16 which is contoured with a series of concentric grooves which form prisms that redirect light passing through the front central portion of the operator display 10. A front plate 17 having a rear optical surface 18 defines prisms which cooperate with the optical surface 16 to uniformly disperse the light passing therethrough. Although the means by which the light is dispersed uniformly through the front central portion of the operator display is not essential to this invention, it is fully disclosed in U.S. patent application Ser. No. 589,569 for Indicator Light Assembly For Control Panel filed Mar. 14, 1984, and that disclosure is hereby incorporated by reference.

The operator display 10 also has a peripheral flange portion 19 which is forward of and radially outward from the cylindrical portion 12. The flange portion 19 enables a human to grasp the operator display 10 and twist it to manipulate the switch. Twisting may be facilitated by a knurl 20 on the outer circumference of the flange portion 19.

Figure 3:
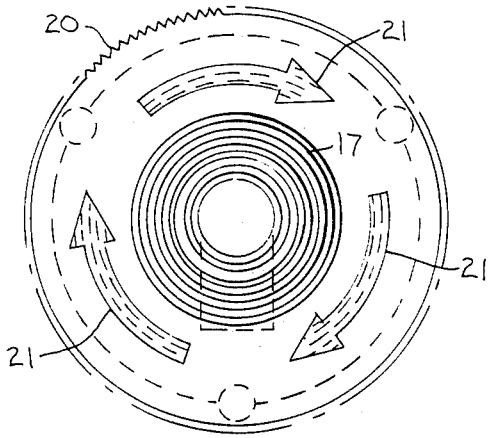
FIG. 3 is a front plan view of the display of FIG. 1.

Referring to FIG. 3, three indicator arrows 21 are molded on the front surface of the flange portion. The arrows 21 protrude slightly above the front surface of the flange portion and point in a direction to indicate the proper operation of the switch 11. The arrows 21 are optional, as will be more fully explained below.

Figure 4:
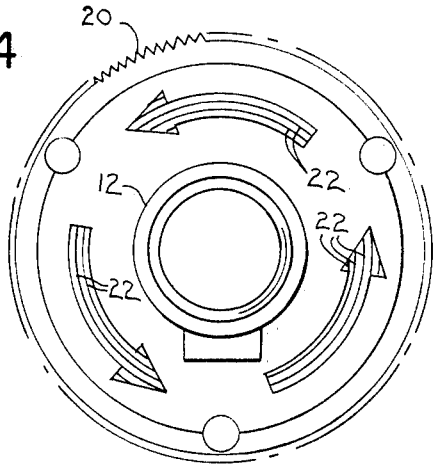
FIG. 4 is a rear plan view of the display of FIG. 1.

As best shown in FIG. 4, the rear surface of the flange portion 18 is contoured to provide a series of concentric ridges 22, each series of ridges 22 defines an arrow which is substantially aligned with the arrows 21 on the front surface of the flange portion 19. While the ridges 22 are shown as being recessed with their peaks in the plane of the surrounding rear surface of the flange portion 19, they need not be recessed as long as they are arranged in the general shape of an arrow. As will be pointed out below, the ridges 22 redirect light into a bundle of parallel rays having a cross section which is in the general shape of an arrow and which is readily visible by an observer in front of the operator display 10.

The switch 11 supports an indicator lamp 23 within the sleeve 14 and the cylindrical portion 12 rearward of the flange portion 19. The indicator lamp 23 has a filament 24 which emits light when it is energized. The lamp 23 can be energized when the operator display 10 is in the depressed position, the extended position, or it can be energized in both positions.

The operator display 10 and the sleeve 14 are made of a transparent material having a relatively high index of refraction. A material having an index of refraction of 1.4–1.6 is suitable, although other materials would also be suitable. Several commercially available nylon molding compounds could be used. They could be colored or clear, with the material of the sleeve 14 being preferably clear so that different colored operator displays 10 would be interchangeable. Since the index of refraction of the material of which the operator display 10 and the sleeve 14 are made is substantially greater than 1, light travels through the operator display 10 and the sleeve 14 slower than it does through air. Consequently, a light ray passing from air to the operator display will be bent toward a line which is normal to the boundary surface and when it passes back to air it will be redirected away from the normal.

Figure 5:
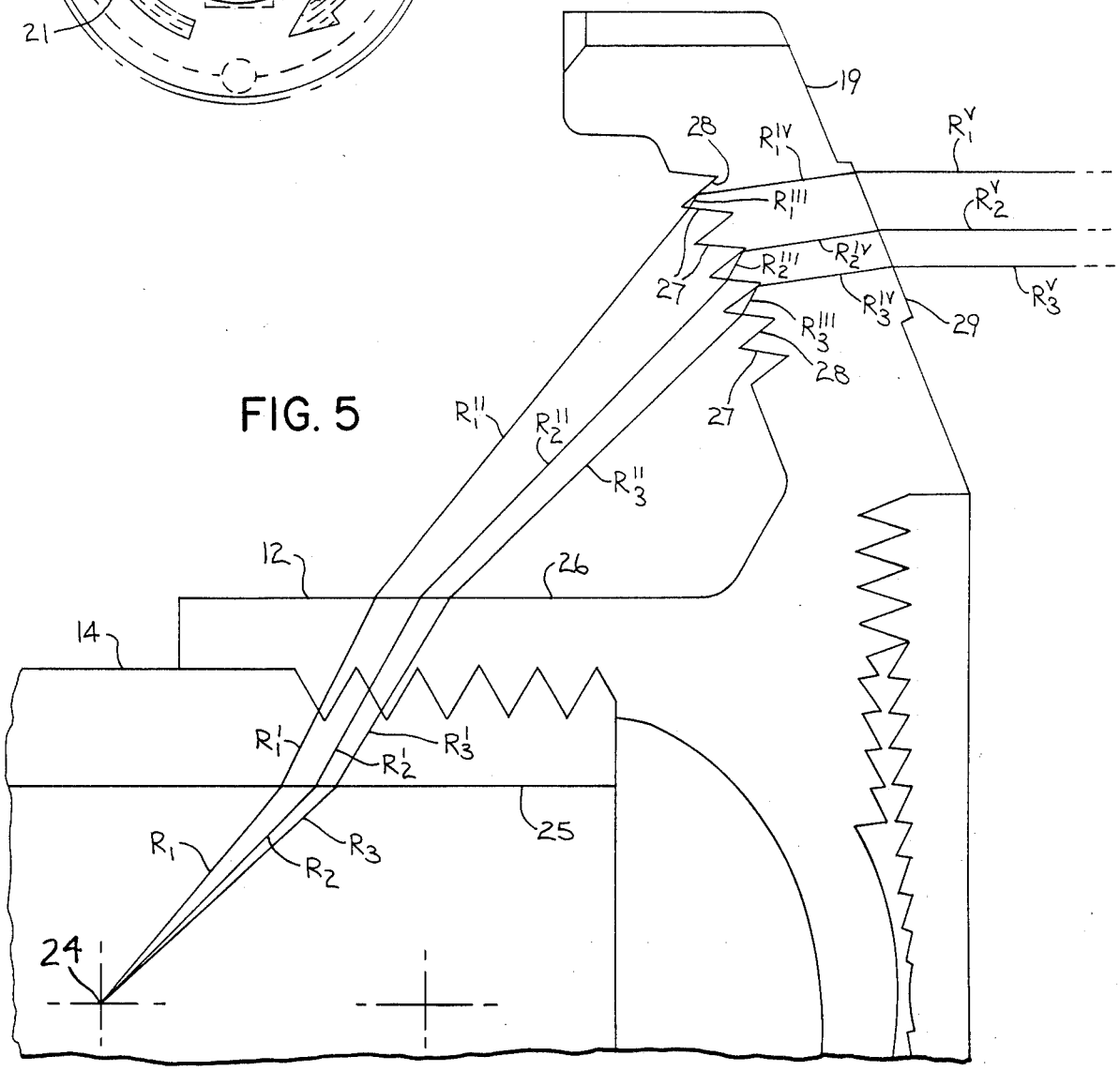
FIG. 5 is a schematic view of the display of FIG. 1 which shows the passage of light therethrough.

FIG. 5 shows the analytical paths of three representative light rays. In the explanation which follows, it should be understood that there will be minor losses and deviations from the path shown due to manufacturing tolerances and microscopic defects. To minimize these deviations from the theoretical, all optical surfaces should be of a high polish finish. Also, since all the rays, not only those shown, undergo the same type of redirection, it is only necessary to describe the path of one of the rays.

Still referring to FIG. 5, ray $R_1$ emanates from the filament 24 and is incident on a first optical surface 25, which is the inner surface of the sleeve 14. Ray $R_1$ is refracted as it enters the sleeve 14 and the redirected ray $R_1$ is designated as $R_1'$. Defining the angle of incidence $\theta_1$ as the angle subtended by ray $R_1$ and a line normal to the surface 25 and the angle of refraction $\theta_2$ as the angle subtended by ray $R_1'$ and the normal line, the relationship between the angle of incidence $\theta_1$ and the angle of refraction $\theta_2$ will be determined by the index of refraction of the material of the sleeve 14 according to the following relationship:

$$n_1 \sin \theta_1 = n_2 \sin \theta_2$$

where $n_1$ equals the index of refraction of air and $n_2$ equals the index of refraction of the material of the sleeve 14. This relationship is commonly known as Snell's law.

Ray $R_1'$ is then incident upon the outer surface of the sleeve 14 on which the screw threads are formed. Although there may be some imperfections in the fit of the screw threads of the sleeve 14 and the screw threads of the cylindrical portion 12 in that there may be some microscopic air spaces between the threads, these will be minor. Therefore, the matching parallel surfaces of the threads of the sleeve 14 and the threads of the cylindrical portion 12 tend to cancel each other and do not change the general direction of ray $R_1'$. This would not be the case if the cylindrical portion 12 was made of material which had an index of refraction which was substantially different from that of the material of the sleeve 14. Also note that the threaded surfaces of the sleeve 14 and the cylindrical portion 12 are optical surfaces even though they don't change the direction of a light ray passing through them. Therefore, they should be of a high polish finish.

The next boundary which ray $R_1'$ meets is a second optical surface 26, which is the outer surface of the cylindrical portion 12. Ray $R_1'$ refracts into ray $R_1''$ at surface 26 and the relationship between $R_1'$ and $R_1''$ is determined by Snell's Law. Since the first optical surface 25 and the second optical surface 26 are substantially parallel, $R_1''$ is substantially parallel to ray $R_1$. Although any light ray $R''$ has been redirected twice as it emerges from the cylindrical portion 12, note that the bundle of light rays represented by rays $R_1''$–$R_3''$ is still diverging.

Ray $R_1''$ is incident upon an entrance surface 27 of one of the ridges 22. Ridges 22 operate as catadioptric prisms in that they redirect light entering them through a combination of refraction and total internal reflection into a parallel bundle of light rays. This parallel bundle of light rays, or collimated beam, emerges from the ridges 20 in a direction which causes the light rays to be substantially parallel to the horizontal axis of the operator display 10 when the collimated beam emerges from the front of the flange portion 19.

More particularly, as light ray $R_1''$ enters a prism through the entrance surface 27, it will be refracted according to Sbell's Law and will emerge from surface 27 as ray $R_1'''$ which is directed toward a reflecting surface 28 on the side of the ridge 22 which is opposite from surface 27. Ray $R_1'''$ is incident upon the reflecting surface 28 at a relatively large angle of incidence. Since the angle of incidence is greater than the critical angle of the material of the operator display 10, ray $R_1'''$ is reflected by surface 28 by total internal reflection and becomes $R_1^{IV}$. For any material with an index of refraction of $n_2$ and having a boundary with an air interface where $n_1$ is the index of refraction of air, the critical angle $\theta_c$ (the smallest angle subtended by a totally reflected ray and a line normal to the boundary) is defined by the relationship:

$$\sin \theta_c = n_1/n_2$$

The surfaces 27 and 28 are related so that the bundle of light rays represented by rays $R_1^{IV}$–$R_3^{IV}$ will be substantially parallel to one another and will be in a certain direction. The relationship between the surfaces 27 and 28 will depend upon the particular dimensions of the operator display and the location of the filament 24 relative to the operator display. The optical principals and geometric relationships necessary to calculate this relationship are well known to those skilled in the art so that they need not be explained here.

As noted above, the collimated beam represented by rays $R_1^{IV}$–$R_3^{IV}$ proceed in a certain direction. This direction is chosen so that the collimated beam represented by rays $R_1^{V}$–$R_3^{V}$ emanating from a third optical surface 29, which is the front surface of an arrow 21, will be generally parallel to the horizontal axis of the operator display 10. The relationship between the collimated beam before it passes through the surface 29 and the collimated beam after it passes through the surface 29 will also be determined by Snell's Law. In this regard, it should be noted that the optical surface 29 is angled rearwardly so that the ridges 22 can be oriented to expose more area of the entrance surfaces 27 to the bundle of rays represented by rays $R_1''$–$R_3''$ for a more intense light signal after the rays have been collimated by the ridges 22.

Since the ridges 22 are arranged in the shape of an arrow, the collimated beam represented by rays $R_1^{V}$–$R_3^{V}$ is in the general shape of an arrow. The arrow is readily visible to an observer positioned in front of the operator display since the arrow is the result of a concentrated collimation of light which is particularly directed toward the observer.

The raised arrows 21 are transversely aligned with the ridges 22 along a direction parallel to the rays $R_1^{IV}$–$R_3^{IV}$. The arrows 21 are not necessary to the invention, but serve to add definition to the light beam emerging from the ridges 22. If the arrows 21 were ground off or otherwise removed so that the surface 29 was flush with the surrounding area of the front surface of the peripheral flange portion 19, the cross section of the collimated beam represented by the rays $R_1^{V}$–$R_3^{V}$ would still be in the general shape of an arrow.

As noted above and from FIGS. 1 and 2, the filament 24 could be energized in either of two positions relative to the operator display 10. The position illustrated in FIG. 5 is the extended position of the operator display 10, however, the description with respect thereto is the same for the retracted position. For small differences between the extended and the retracted positions, an operator display 10 designed for display illumination in one position would probably also operate satisfactorily in the other position. Alternatively, the parameters of the operator display 10 could be chosen with respect to a theoretical filament position midway of the extended and the retracted postions. This way, the same operator display may illuminate satisfactorily in both positions although they are spaced a considerable distance apart.

Another means by which an operator display 10 may be made to illuminate a display in either of two positions relative to the filament 24 is to provide the reflecting surfaces 28 of the ridges 22 with a contour. The contour is chosen so that one portion of each of the surfaces 28 is most effective to reflect the light rays in the desired direction when the operator display 10 is in one position, and another portion is most effective to reflect the light rays in the desired direction when the operator display is in the other position. The contour may simply be a radius, however, it may not be practical to provide such contours in small parts due to molding and measurement considerations.

Numerous modifications and variations of the invention will be apparent to those skilled in the art. For example, the invention does not require that the light emanating from the filament 24 pass through the sleeve 14. The cylindrical portion 12 could be extended rearwardly and the threads could be provided in the extended portion so that the light would only pass through the cylindrical portion on its way to the ridges 22. It should also be apparent that an illuminated display of the present invention can be employed as an information display by itself or can be incorporated into other electrical components to be used as both a display and also as a manually operable portion of the component, as in the preferred embodiment. Therefore, it is not intended that the invention be limited to the preferred embodiment and the variations shown and described, but only by the claims which follow, except as otherwise required by law.

I claim:

1. In a display for communicating information to an observer positioned forward of the display when an indicator lamp having a light emitting filament which is disposed rearward of the display is energized, the improvement wherein:

the display is formed from a material having an index of refraction substantially greater then 1 and a plurality of prisms are formed on the rear surface of the display and are arranged in a shape which is representative of the information to be communicated to redirect the light entering the prisms into a collimated light beam so that the transverse cross section of the collimated beam is in the general shape of the display; and the display comprises a generally circular cylindrical portion which defines a circular cylindrical space and a peripheral flange portion which is forward of and radially outward from from the cylindrical portion, the flange portion having a forward surface and a rearward surface, the prisms being formed on the rearward surface of the flange portion.

2. The improvement of claim 1, wherein the indicator lamp filament is disposed within the cylindrical space so that light emitted from the filament passes through the cylindrical portion before becoming incident upon the prisms.

3. The improvement of claim 2, wherein the forward surface of the flange portion is slanted rearwardly to enable exposing a larger area of the prisms to the light emitted from the filament than if the forward surface were in a vertical plane and to refract the collimated beam to a direction which is substantially parallel to the axis of the cylindrical portion.

4. The improvement of claim 3, wherein the plurality of prisms comprises a series of concentric ridges, each ridge having an entrance surface and reflecting surface so that the ridges act as catadioptric prisms.

5. An illuminated display assembly for conveying information to an observer positioned forward of the display, comprising:

an indicator lamp having a filament which emits light when the lamp is energized;

an operator display formed from a transparent material having an index of refraction substantially greater than one, the operator display having a generally circular cylindrical rearward portion which defines a circular cylindrical space and having a peripheral flange portion disposed radially outward from and forward of the cylindrical portion, the flange portion having a forward surface and a rearward surface;

support means for mounting the cylindrical portion and holding the indicator lamp within the cylindrical space rearward of the flange portion; and wherein the rearward surface of the flange portion is contoured to provide a plurality of prisms, the prisms being arranged in the shape of a display which is representative of the information to be conveyed and being suitable for redirecting light which has emitted from the filament and passed through the cylindrical portion into generally parallel rays directed toward the forward surface of the flange portion so that the transverse cross section of the rays is in the general shape of the display and the rays are directed toward the observer.

6. An illuminated display assembly as recited in claim 5, wherein the prisms comprise a series of concentric ridges, each ridge having an entrance surface and a reflecting surface so that the ridges act as catadioptric prisms.

7. An illuminated display as in claim 6, wherein the forward surface of the flange portion is slanted rearwardly so that the ridges can be oriented to expose more area of the entrance surfaces to the light emitted from the filament than if the forward surface were vertical.

8. An illuminated display assembly as in claim 7, wherein the area of the forward face of the flange portion which is substantially aligned with the prisms along the light rays which pass between the rearward and the forward surfaces of the flange portion is raised and is in the shape of the display.

9. An illuminated display as in claim 8, wherein the support means comprises an electrical twist type switch with the operator display forming a portion of a movable actuator which operates the switch and the ridges are arranged in the shape of an arrow to indicate the direction of rotation of the operator display to operate the switch.

10. An illuminated display assembly as in claim 9, wherein the support means comprises a circular cylindrical sleeve made from a transparent material having an index of refraction substantially greater than one and wherein the cylindrical portion of the operator display is mounted to the sleeve in overlapping relationship so that the light rays emitted from the filament pass through both the cylindrical portion of the operator display and the sleeve.

* * * * *